US009812773B1

(12) United States Patent
Zheng

(10) Patent No.: US 9,812,773 B1
(45) Date of Patent: Nov. 7, 2017

(54) ANTENNA DESIGN FOR REDUCED SPECIFIC ABSORPTION RATE

(71) Applicant: Amazon Technologies, Inc., Reno, NV (US)

(72) Inventor: Ming Zheng, Cupertino, CA (US)

(73) Assignee: Amazon Technologies, Inc., Seattle, WA (US)

( * ) Notice: Subject to any disclaimer, the term of this patent is extended or adjusted under 35 U.S.C. 154(b) by 841 days.

(21) Appl. No.: 14/082,418

(22) Filed: Nov. 18, 2013

(51) Int. Cl.

| | |
|---|---|
| ***H01Q 1/52*** | (2006.01) |
| ***H01Q 1/24*** | (2006.01) |
| ***H01Q 21/00*** | (2006.01) |
| ***H01Q 5/392*** | (2015.01) |
| ***H01Q 5/378*** | (2015.01) |

(52) U.S. Cl.
CPC ..... *H01Q 1/52* (2013.01); *H01Q 1/243* (2013.01); *H01Q 5/378* (2015.01); *H01Q 5/392* (2015.01); *H01Q 21/0006* (2013.01)

(58) Field of Classification Search
CPC ..... H01Q 1/52; H01Q 1/243; H01Q 5/378; H01Q 5/392; H01Q 21/0006
USPC ..... 343/841
See application file for complete search history.

(56) References Cited

U.S. PATENT DOCUMENTS 6,885,880 B1 * 4/2005 Ali ..... G06F 1/1616 343/702
9,350,077 B1 * 5/2016 Zheng ..... H01Q 7/00
2005/0159195 A1 * 7/2005 Huber ..... H01Q 1/243 455/575.5
2008/0001831 A1 * 1/2008 Park ..... H01Q 1/245 343/702
2008/0316114 A1 * 12/2008 Qi ..... H01Q 1/243 343/702
2009/0085812 A1 * 4/2009 Qi ..... H01Q 1/243 343/702
2009/0143040 A1 * 6/2009 Man ..... H01Q 1/243 455/274
2011/0316750 A1 * 12/2011 Yen ..... H01Q 19/28 343/702
2012/0200463 A1 * 8/2012 Kim ..... H01Q 9/42 343/700 MS
2013/0050049 A1 * 2/2013 Liu ..... H01Q 1/245 343/860
2013/0069847 A1 * 3/2013 Chiang ..... H01Q 1/245 343/893
2015/0288074 A1 * 10/2015 Harper ..... H01Q 1/243 343/833

* cited by examiner

*Primary Examiner* — Dameon E Levi
*Assistant Examiner* — Jennifer F Hu
(74) *Attorney, Agent, or Firm* — Weaver Austin Villeneuve & Sampson LLP

(57) ABSTRACT

An antenna for use in portable wireless devices is described for which SAR is significantly reduced relative to conventional antenna designs for the same transmit power. The antenna includes a primary antenna element and one or more parasitic antenna elements. Each parasitic antenna element is electromagnetically coupled to the primary antenna element so as to spread out the RF energy associated with SAR hotspots.

20 Claims, 4 Drawing Sheets

ANTENNA DESIGN FOR REDUCED SPECIFIC ABSORPTION RATE

BACKGROUND

Specific Absorption Rate (SAR) is a measure of the rate at which energy is absorbed by the human body when exposed to Radio Frequency (RF) energy. SAR is defined as the power absorbed per mass of tissue and has units of watts per kilogram (W/kg) or milliwatts per gram (mW/g). SAR is usually averaged either over the whole body or over a small sample volume (typically 1 gram or 10 grams of tissue). The Federal Communications Commission (FCC) has adopted limits on SAR for cellular and wireless devices below which the level of exposure is considered safe. Currently, the FCC limit for exposure from such devices is 1.6 milliwatts per gram (1.6 mW/g). Manufacturers of cellular and wireless electronic devices face a difficult challenge in meeting the FCC limit for SAR while still providing sufficiently high RF transmission power to ensure an acceptable level of device performance.

DETAILED DESCRIPTION

This disclosure describes an antenna for use in wireless devices, e.g., tablet computers or other portable multimedia devices, for which SAR is significantly reduced relative to conventional antenna designs operating at the same transmit power. The antenna includes a primary antenna element and one or more parasitic antenna elements. The primary antenna element is coupled to a source of RF energy, e.g., an RF power amplifier, and, based on the configuration of the primary antenna element, it exhibits one or more SAR hotspots, i.e., locations at which SAR is significantly higher than the surrounding area, due to the concentration of current when the antenna is transmitting. Each parasitic antenna element is electromagnetically coupled to the primary antenna element (e.g., via an intervening dielectric) to create one or more additional SAR hotspots due to the concentration of current in the parasitic element(s) near the region(s) of the coupling with the primary antenna element. The region(s) of coupling between the primary antenna element and the parasitic element(s) are selected so as to spread out the RF energy associated with SAR hotspots. As a result, SAR near the surface of the device is significantly reduced for a given transmit power relative to conventional designs that only include a primary antenna element.

Figure 1:
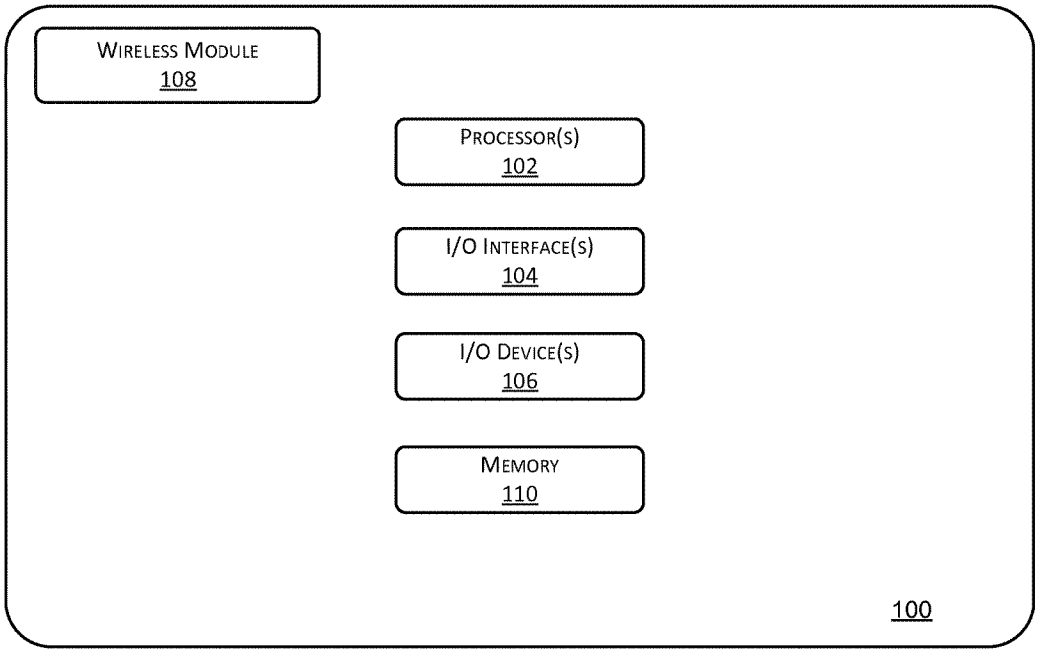
FIG. 1 is a simplified block diagram of an electronic device that includes an antenna.

FIG. 1 is a block diagram of an electronic device 100 (e.g., a tablet computing device or other portable multimedia device). Device 100 may include one or more processors 102 configured to execute stored instructions. Each of processor(s) 102 may include one or more processor cores. Device 100 may include one or more input/output ("I/O") interface(s) 104 to allow device 100 to communicate with other devices. I/O interface(s) 104 may include, for example, inter-integrated circuit ("I2C"), serial peripheral interface bus ("SPI"), universal serial bus ("USB"), RS-232, media device interface, etc.

I/O interface(s) 104 may couple to one or more I/O devices 106. I/O device(s) 106 may include one or more displays, sensor assemblies, controllers, haptic generators, capacitive touch sensor arrays, accelerometers, motion sensors, orientation sensors, etc. The one or more displays (not shown) are configured to provide visual output to the user. The one or more displays may include an electrophoretic or cholesteric material and may be configured to present an image using reflected light, ambient light, light from a front light, etc.

Device 100 may also include one or more wireless communication modules 108 configured to provide communications between device 100 and other devices. Wireless module 108 may include one or more receivers, transmitters, transceivers, signal conditioners, RF power amplifiers, antenna(s), or other components associated with wireless communications. In some implementations, wireless module 108 may be integrated into another component, e.g., into a PCB. Wireless module 108 may be configured to provide communications capabilities according to one or more wireless standards including, but not limited to, 3G, 4G, Bluetooth, 802.11, or WiMAX standards.

Device 100 also includes one or more memories 110. Memory 110 may include one or more non-transitory computer-readable storage media ("CRSM"). The CRSM may be any one or more of an electronic storage medium, a magnetic storage medium, an optical storage medium, a quantum storage medium, a mechanical computer storage medium, etc. Memory 110 provides storage of computer readable instructions, data structures, program modules and other data for the operation of the device 100.

Figure 2:
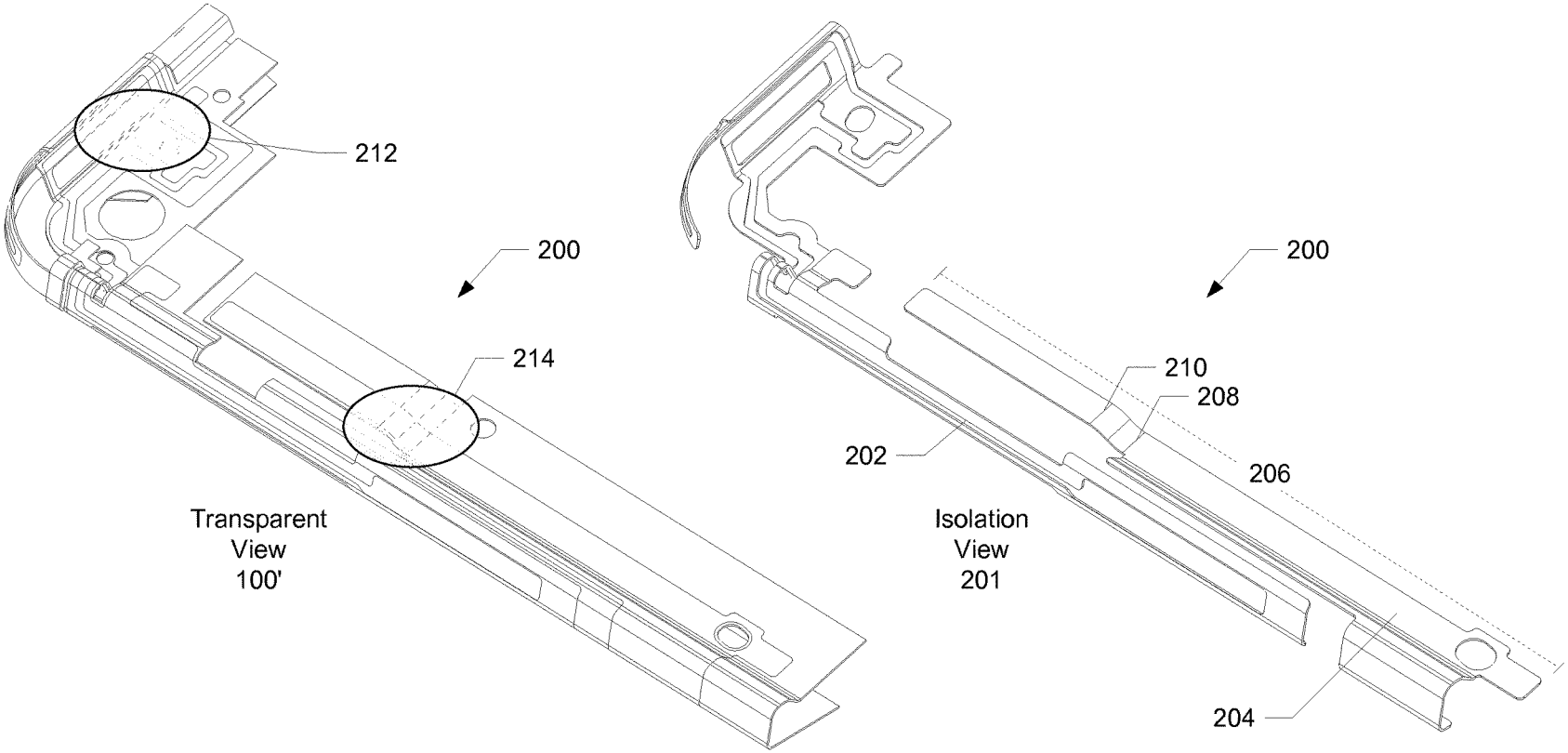
FIG. 2 includes two perspective views of a specific implementation of an antenna.

According to a particular implementation illustrated in FIG. 2, wireless module 108 includes a multi-element antenna 200 configured for reduced SAR. Antenna 200 is shown in a transparent view 100' of a corner of electronic device 100 in which other components of device 100 and wireless module 108 are not shown in order to better illustrate the configuration of antenna 200. Antenna 200 (also shown in isolation view 201) includes a primary antenna element 202 which is coupled to an RF amplifier (not shown) and which is configured to transmit RF energy received from the RF amplifier around a center frequency of 1800 MHz. In this example, primary antenna element 202 is shown as a folded monopole antenna element but may employ other configurations including, but not limited to, a monopole element, a dipole element, an Inverted F-Antenna (IFA) element, a Planar IFA (PIFA) element, a loop element, folded versions of any of these, and/or any combination of any of these. More generally, any antenna element suitable for use in mobile electronic devices may be employed in implementations guided by and benefiting from the principles described herein.

Antenna 200 also includes a floating parasitic antenna element 204 that is electromagnetically coupled to portion of primary element 202 (e.g., via an intervening dielectric) from which it receives a portion of the RF energy transmitted by primary element 202. That is, parasitic element 204 is not grounded or electrically coupled to primary element 202 by an intervening conductor or conductive material. Instead it is excited by and retransmits a portion of the RF energy originating from primary element 202 that propagates through the intervening dielectric material (e.g., air or any of a variety of plastics or polymers in which the components are embedded). Parasitic element 204 is configured to transmit RF energy around the same center frequency as primary element 202; in this case 1800 MHz. That is, as would be understood by those of skill in the art, the physical shape and dimensions of parasitic element 204 are designed to efficiently transmit RF energy around that center frequency. However, it will also be understood that other frequency bands around other frequencies are contemplated. For example, implementations are contemplated in which both antenna elements are configured for center frequencies of 700 MHz, 850 MHz, 900 MHz, or 1900 MHz. Further, in the implementation shown, parasitic element 204 is electrically isolated from primary element 202. However, implementations are contemplated in which some electrical coupling between antenna elements is permitted. The holes in antenna elements 202 and 204 are alignment features for placement of the antenna elements on a mid-frame or chassis of electronic device 100.

In the depicted implementation, at least one dimension of parasitic element 204, e.g., dimension 206, substantially corresponds or is substantially equivalent to ½ the wavelength of the center frequency for which antenna 200 is designed (e.g., 1800 MHz). As will be understood by those of skill in the art, a variety of element configurations and geometries may be employed to achieve substantial equivalency with ½ the wavelength of the center frequency. For example, ½ the wavelength of an 1800 MHz signal is slightly more than 83 millimeters. However by introducing bends in the parasitic element (e.g., bends 208 and 210) its overall length can be significantly reduced from this number while still being configured for the same center frequency. Those of skill in the art will understand how to vary the configuration and geometry of parasitic elements to suit antenna designs as described herein for particular applications.

The effect of floating parasitic element 204 may be understood with reference to SAR hotspots 212 and 214. Without floating parasitic element 204, an SAR hotspot 212 would be concentrated proximate a location on primary element 202 at which there is a high current concentration. However, the addition of parasitic element 204 results in a second hotspot 214 proximate the area around where the coupling between the antenna elements is the greatest and there is a high current concentration in parasitic element 204, thereby dividing the radiated RF energy between the hotspots 212 and 214. That is, as is well known in the art, an antenna element may be configured to efficiently radiate or transmit RF energy around a particular frequency if at least one dimension of that element corresponds or is substantially equivalent to ½ the wavelength of that frequency. And because the total amount of transmitted RF energy remains the same as the case without a parasitic element, the presence of parasitic element 204 (which is excited by and retransmits a portion of the RF energy originating from primary element 202) means that the portion of the total RF energy transmitted by primary element 202 is correspondingly reduced. This, in turn, means that the magnitude of hotspot 212 is also reduced.

That is, RF energy is electromagnetically coupled from primary element 202 to adjacent parasitic element 204. The configuration of parasitic element 204 and its proximity to primary element 202 causes parasitic element 204 to have a relatively high current concentration at a location on parasitic element 204 displaced from the location of the hotspot of primary element 202. That is, the resulting hotspot (e.g., 214) is displaced from the location of the primary element hotspot (e.g., 212), thus dividing energy between the two hotspots, i.e., spreading the energy distribution out. Because the hotspots are physically displaced (e.g., in this case by a few centimeters), the SAR value (e.g., a measurement in W/kg or mW/g) measured at any given location at the surface of the device for a given power level is greatly reduced relative to an implementation without such a floating parasitic element. As will be understood, significant reduction in SAR may be achieved when the multiple hotspots are at least about 10 mm apart. That is, because SAR values typically represent a measurement of RF power per unit weight of human tissue (e.g., 1.6 mW/gram of tissue) that represents roughly a cubic centimeter of tissue, if the hotspots were closer together than 10 mm, they might still look too much like a single hotspot and therefore the device would be at risk for not passing SAR testing. However, it should be noted that some SAR reduction may still be achieved in implementations where this is not the case and that such implementations are therefore contemplated.

SAR measurements were taken for an electronic device with a primary antenna element such as primary element 202; both with and without a parasitic antenna element such as parasitic element 204. The results showed a significant reduction in SAR associated with the hotspot of the primary element (e.g., SAR hotspot 212). As shown in Table 1,

TABLE 1

| Frequency (MHz) | SAR (mw/g) No parasitic | SAR (mw/g) With parasitic |
|---|---|---|
| 1715.0 | 8.2 | 4 |
| 1732.5 | 7.7 | 4 |
| 1745.0 | 7.4 | 3.8 |

the test measurements show approximately a 50% reduction in SAR over a range of RF test frequencies.

And as long as it sufficiently removed from ground, the floating parasitic element will not typically degrade overall antenna performance. Therefore, implementations are contemplated which employ more than one parasitic element to spread out the SAR hotspots further. As will be understood, the number of parasitic elements is primarily limited by the available physical space for a given application.

Implementations as described herein are to be distinguished from the use of parasitic elements to increase antenna bandwidth in that the parasitic elements for antennas described herein are specifically designed to radiate around substantially the same center frequency as the primary element. By contrast, parasitic elements employed for increasing the bandwidth of an antenna are designed for center frequencies different from that of the primary element.

Figure 3:
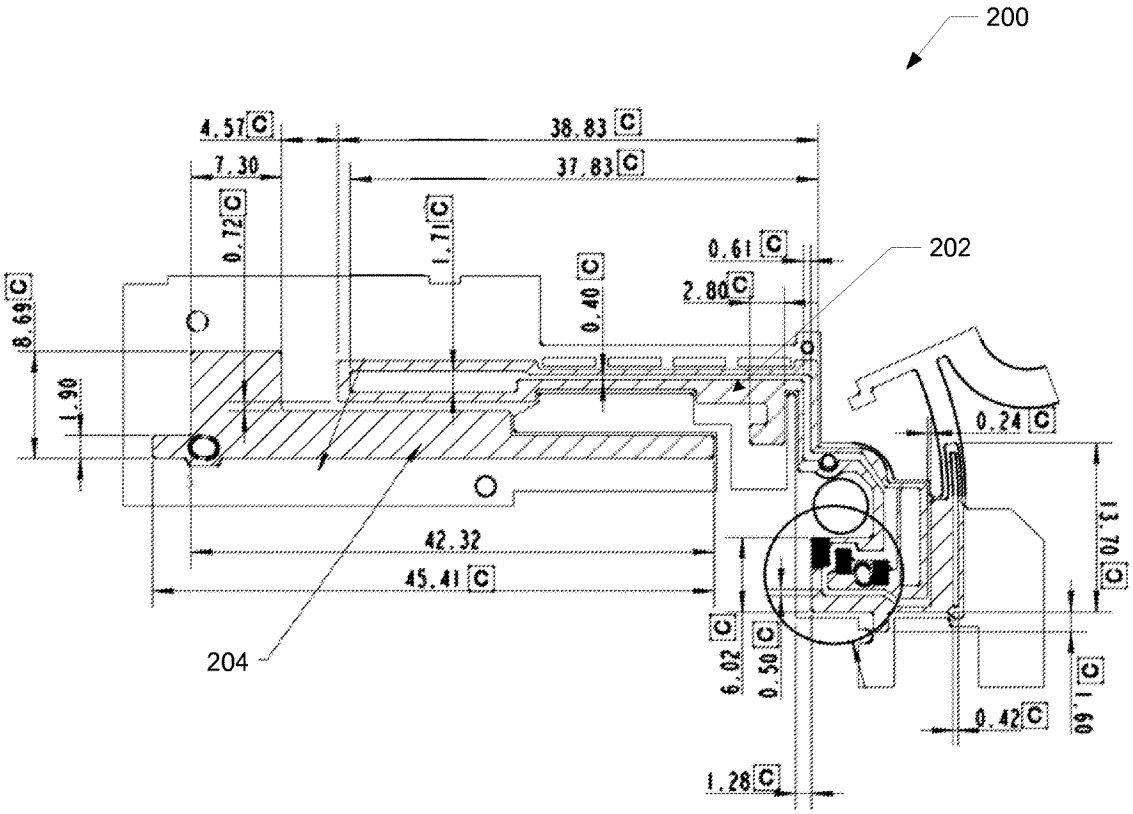
FIG. 3 is a two-dimensional representation of a specific implementation of an antenna.

A two-dimensional representation of antenna 200 of FIG. 2 is shown in FIG. 3 with the various dimensions identified in millimeters. The antenna elements in the depicted implementation are made primarily of copper. However, it should be noted that the geometries, configurations, materials and spacing of the primary element and the parasitic element(s) may vary considerably for different applications and are generally configured to promote coupling between the primary element and the parasitic element(s) in a way that spreads out the energy associated with SAR hotspots. For example, by increasing or decreasing the spacing between the primary and parasitic antenna elements, a corresponding increase or decrease in the amount of electromagnetic coupling between the elements may be achieved. The appropriate size, shape, material and spacing of elements for a given application may be determined empirically, and is likely to be constrained by the space available for that application, e.g., in a device housing.

Figure 4:
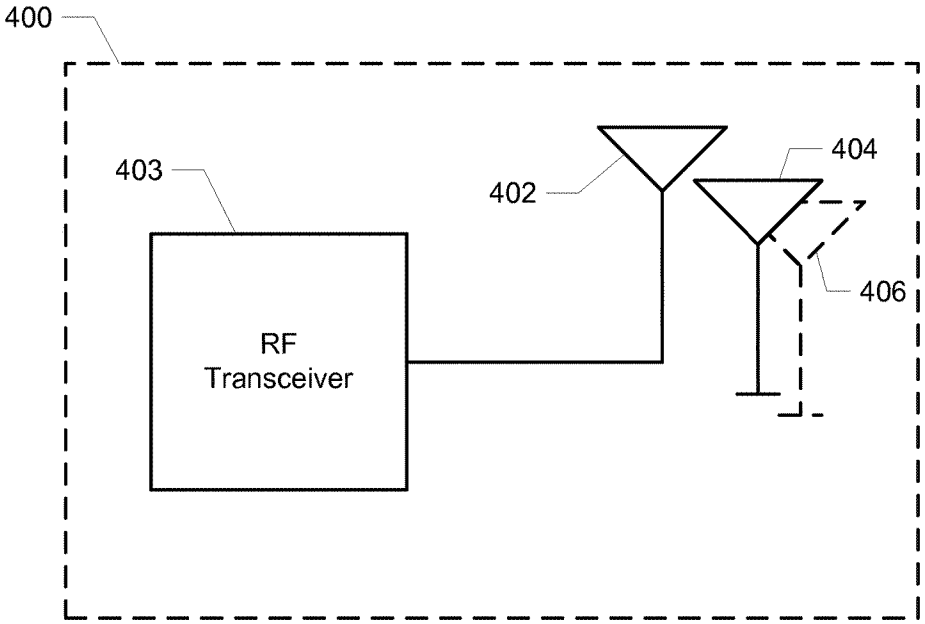
FIG. 4 is a simplified block diagram of an electronic device including an antenna as described herein.

FIG. 4 shows is a simplified block diagram of an implementation of an electronic device 400 including a more generic representation of an antenna as described herein. The antenna includes a primary element 402 coupled to an RF transceiver 403, and a floating parasitic element 404 that is excited by and retransmits a portion of the RF energy received from primary element 402. As mentioned above, parasitic element 404 serves to reduce the intensity associated with RF energy hotspots for a given amount of drive from transceiver 403 that would otherwise result from the use of primary element 402 by itself. One or more additional parasitic elements (represented by dashed-line element 406) may be included to further spread the transmitted RF energy. As will be understood by those of skill in the art, the basic principle depicted may be applied in a wide range of electronic devices and systems with wireless capabilities and having a wide variety of form factors. Suitable configurations, spacing, dimensions and materials will depend on the particular application. The scope of the present invention should therefore not be limited to specific implementations described herein.

While the subject matter of this application has been particularly shown and described with reference to specific implementations thereof, it will be understood by those skilled in the art that changes in the form and details of the disclosed implementations may be made without departing from the spirit or scope of the invention. Examples of some of these implementations are illustrated in the accompanying drawings, and specific details are set forth in order to provide a thorough understanding thereof. It should be noted that implementations may be practiced without some or all of these specific details. In addition, well known features may not have been described in detail to promote clarity. Finally, although various advantages have been discussed herein with reference to various implementations, it will be understood that the scope of the invention should not be limited by reference to such advantages. Rather, the scope of the invention should be determined with reference to the appended claims.

What is claimed is:

1. An electronic device, comprising:

one or more processors;

one or more memories;

one or more displays; and a wireless module, the wireless module comprising a radio frequency (RF) amplifier configured to generate RF energy, and an antenna, the antenna including:

a first antenna element configured to transmit the RF energy in a frequency band around a center frequency, the first antenna element being configured such that during transmission of the RF energy the first antenna element is characterized by a first specific absorption rate (SAR) hotspot proximate a first location on the first antenna element, the first SAR hotspot having a higher SAR value than a surrounding area of the first antenna element; and a second antenna element disposed within less than about 5 millimeters of the first antenna element and electrically floating relative to the first antenna element and configured to receive a portion of the RF energy from the first antenna element via electromagnetic coupling in a region proximate a second location on the first antenna element, wherein the second location is displaced from the first location by a predetermined distance, the second antenna element also being configured to transmit the portion of the RF energy in the frequency band around the center frequency, the second antenna element also having a geometry at a third location on the second antenna element in the region, wherein the geometry promotes coupling of the RF energy from the first antenna element such that during transmission of the portion of the RF energy received from the first antenna element the second antenna element is characterized by a second SAR hotspot proximate the third location on the second antenna element, wherein the predetermined distance ensures that the first and second SAR hotspots do not appear as a single SAR hotspot during SAR testing, and wherein the second antenna element has a length that is substantially equivalent to ½ of a wavelength that corresponds to the center frequency.

2. The electronic device of claim 1, wherein the antenna further comprises one or more additional antenna elements disposed proximate and electrically floating relative to the first antenna element and configured to receive an additional portion of the RF energy from the first antenna element via electromagnetic coupling, each additional antenna element also being configured to transmit the additional portion of the RF energy in the frequency band around the center frequency, each additional antenna element also being configured such that during transmission of the additional portion of the RF energy received from the first antenna element the additional antenna element is characterized by an additional SAR hotspot proximate a corresponding location on the additional antenna element.

3. An antenna, comprising:

a first antenna element configured to transmit radio frequency (RF) energy around a center frequency, the first antenna element being configured such that during transmission of the RF energy the first antenna element is characterized by a first specific absorption rate (SAR) hotspot proximate a first location on the first antenna element; and a second antenna element disposed proximate and electrically floating relative to the first antenna element and configured to receive a portion of the RF energy from the first antenna element via electromagnetic coupling in a region proximate a second location on the first antenna element, wherein the second location is displaced from the first location by a predetermined distance, the second antenna element also being configured to transmit the portion of the RF energy around the center frequency, the second antenna element also having a geometry at a third location on the second antenna element in the region, wherein the geometry promotes coupling of the RF energy from the first antenna element such that during transmission of the portion of the RF energy received from the first antenna element the second antenna element is characterized by a second SAR hotspot proximate the third location on the second antenna element in the region, wherein the predetermined distance ensures that the first and second SAR hotspots do not appear as a single SAR hotspot during SAR testing.

4. The antenna of claim 3, wherein the center frequency is one of 700 MHz, 850 MHz, 900 MHz, 1800 MHz, or 1900 MHz.

5. The antenna of claim 3, wherein the second antenna element has at least one dimension that is substantially equivalent to ½ of a wavelength that corresponds to the center frequency.

6. The antenna of claim 5, wherein the at least one dimension comprises a length of the second antenna element.

7. The antenna of claim 3, wherein the first antenna element comprises one of a monopole element, a dipole element, an Inverted F-Antenna (IFA) element, a Planar IFA (PIFA) element, a loop element, a folded monopole element, a folded dipole element, or a folded loop element.

8. The antenna of claim 3, further comprising one or more additional antenna elements disposed proximate and electrically floating relative to the first antenna element and configured to receive an additional portion of the RF energy from the first antenna element via electromagnetic coupling, each additional antenna element also being configured to transmit the additional portion of the RF energy around the center frequency, each additional antenna element also being configured such that during transmission of the additional portion of the RF energy received from the first antenna element the additional antenna element is characterized by an additional SAR hotspot proximate a corresponding location on the additional antenna element.

9. The antenna of claim 3, wherein the first and second antenna elements are configured such that the first and second SAR hotspots are at least about 10 mm apart.

10. An electronic device, comprising:

one or more processors;

one or more memories;

a radio frequency (RF) amplifier configured to generate RF energy; and an antenna, the antenna including:

a first antenna element configured to transmit the RF energy around a center frequency, the first antenna element being configured such that during transmission of the RF energy the first antenna element is characterized by a first specific absorption rate (SAR) hotspot proximate a first location on the first antenna element; and a second antenna element disposed proximate and electrically floating relative to the first antenna element and configured to receive a portion of the RF energy from the first antenna element in a region proximate a second location on the first antenna element, wherein the second location is displaced from the first location by a predetermined distance, the second antenna element also being configured to transmit the portion of the RF energy around the center frequency, the second antenna element also having a geometry at a third location on the second antenna element in the region, wherein the geometry promotes coupling of the RF energy from the first antenna element such that during transmission of the portion of the RF energy received from the first antenna element the second antenna element is characterized by a second SAR hotspot in the region, and wherein the predetermined distance ensures that the first SAR hotspot and the second SAR hotspot do not appear as a single SAR hotspot during SAR testing.

11. The electronic device of claim 10, wherein the center frequency is one of 700 MHz, 850 MHz, 900 MHz, 1800 MHz, or 1900 MHz.

12. The electronic device of claim 10, wherein the second antenna element has at least one dimension that is substantially equivalent to ½ of a wavelength that corresponds to the center frequency.

13. The electronic device of claim 12, wherein the at least one dimension comprises a length of the second antenna element.

14. The electronic device of claim 10, wherein the first antenna element comprises one of a monopole element, a dipole element, an Inverted F-Antenna (IFA) element, a Planar IFA (PIFA) element, a loop element, a folded monopole element, a folded dipole element, or a folded loop element.

15. The electronic device of claim 10, further comprising a third antenna element disposed proximate and electrically floating relative to the first antenna element and configured to receive an additional portion of the RF energy from the first antenna element, the third antenna element being configured to transmit the additional portion of the RF energy around the center frequency, the third antenna element also being configured such that during transmission of the additional portion of the RF energy received from the first antenna element the third antenna element is characterized by third SAR hotspot proximate a corresponding location on the third antenna element.

16. An antenna, comprising:

a first antenna element configured to transmit radio frequency (RF) energy around a center frequency such that the first antenna element is characterized by a first specific absorption rate (SAR) hotspot proximate a first location on the first antenna element; and a second antenna element disposed proximate and electrically floating relative to the first antenna element and configured to receive a portion of the RF energy from the first antenna element in a region proximate a second location on the first antenna element, wherein the second location is displaced from the first location by a predetermined distance, the second antenna element also having a geometry at a third location on the second antenna element in the region, wherein the geometry promotes coupling of the RF energy from the first antenna element such that the second antenna element is characterized by a second SAR hotspot in the region, and wherein the predetermined distance ensures that the first SAR hotspot and the second SAR hotspot do not appear as a single SAR hotspot during SAR testing.

17. The antenna of claim 16, wherein the center frequency is one of 700 MHz, 850 MHz, 900 MHz, 1800 MHz, or 1900 MHz.

18. The antenna of claim 16, wherein the second antenna element has at least one dimension that is substantially equivalent to ½ of a wavelength that corresponds to the center frequency.

19. The antenna of claim 18, wherein the at least one dimension comprises a length of the second antenna element.

20. The antenna of claim 16, wherein the first antenna element comprises one of a monopole element, a dipole element, an Inverted F-Antenna (IFA) element, a Planar IFA (PIFA) element, a loop element, a folded monopole element, a folded dipole element, or a folded loop element.

* * * * *